United States Patent [19]

Masumoto et al.

[11] 4,318,738

[45] Mar. 9, 1982

[54] AMORPHOUS CARBON ALLOYS AND ARTICLES MANUFACTURED FROM SAID ALLOYS

[75] Inventors: Tsuyoshi Masumoto; Akihisa Inoue; Shunsuke Arakawa, all of Sendai, Japan

[73] Assignee: Shin-Gijutsu Kaihatsu Jigyodan, Tokyo, Japan

[21] Appl. No.: 170,664

[22] PCT Filed: Feb. 1, 1979

[86] PCT No.: PCT/JP79/00024

§ 371 Date: Oct. 3, 1979

§ 102(e) Date: Sep. 25, 1979

[87] PCT Pub. No.: WO79/00674

PCT Pub. Date: Sep. 20, 1979

[30] Foreign Application Priority Data

Feb. 3, 1978 [JP] Japan ..... 53-10397
Dec. 28, 1978 [JP] Japan ..... 53-160978

[51] Int. Cl.[3] ..... C22C 38/32; C22C 38/36; C22C 38/10

[52] U.S. Cl. ..... 75/122; 75/123 B; 75/123 J; 75/123 K; 75/123 M; 75/123 N; 75/126 A; 75/134 F; 75/134 N; 75/171

[58] Field of Search ..... 75/123 N, 123 J, 123 M, 75/123 B, 126 A, 134 F, 134 N, 171, 122, 123 K

[56] References Cited

U.S. PATENT DOCUMENTS

| | | | |
|---|---|---|---|
| 3,663,214 | 5/1972 | Moore et al. | 75/126 A |
| 3,849,078 | 11/1974 | Gobble et al. | 29/183 |
| 3,856,513 | 12/1974 | Chen et al. | 75/122 |
| 3,986,867 | 10/1976 | Masumoto et al. | 75/126 A |
| 4,144,058 | 3/1979 | Chen et al. | 75/170 |
| 4,152,144 | 5/1979 | Hasegawa et al. | 75/122 |

FOREIGN PATENT DOCUMENTS

| | | |
|---|---|---|
| 51-4017 | 1/1976 | Japan . |
| 51-12305 | 1/1976 | Japan . |
| 51-78705 | 7/1976 | Japan . |

*Primary Examiner*—Upendra Roy
*Attorney, Agent, or Firm*—Stevens, Davis, Miller & Mosher

[57] ABSTRACT

Amorphous alloys containing carbon as a metalloid having the amorphous alloy forming ability are low in the production cost because of use of carbon as the metalloid, do not generate harmful gas during production and are easily produced. These alloys have high strength, hardness, crystallizing temperature, embrittling temperature and corrosion resistance. Alloys having high permeability, non-magnetic property or low magnetostriction are obtained depending upon the component composition and the alloys are utilized for various uses depending upon these properties.

17 Claims, 3 Drawing Figures

*Explanation of the Literatures in the Drawings* a----- AISI 304 b----- $Fe_{54}Cr_{28}C_{18}$ c----- $Fe_{68}Mo_{16}C_{16}$ d------ $Fe_{70}W_4Mo_8C_{18}$ e------ $Fe_{61.5}Cr_{17}W_{5.5}C_{16}$ f------ $Fe_{59}Cr_{16}Mo_{10}C_{15}$ g------ $Fe_{55}Cr_{13}W_4Mo_8C_{20}$ h------ $Fe_{70}Cr_{10}P_{13}C_7$

AMORPHOUS CARBON ALLOYS AND ARTICLES MANUFACTURED FROM SAID ALLOYS

TECHNICAL FIELD

The present invention relates to amorphous alloys and articles manufactured from said alloys and particularly to amorphous iron group alloys containing only carbon as a metalloid (amorphous alloy forming element) and articles manufactured from said alloys.

BACKGROUND ART

Solid metals or alloys are generally crystal state but if a molten metal is cooled at an extremely high speed (the cooling rate depends upon the alloy composition but is approximately $10^{4°}$–$10^{6°}$ C./sec), a solid having a non-crystal structure, which has no periodic atomic arrangement, is obtained. Such metals are referred to as non-crystal metals or amorphous metals. In general, this type metal is an alloy consisting of two or more elements and usually consists of a combination of a transition metal element and a metalloid element and an amount of the metalloid is about 15–30 atomic%.

Japanese Patent Laid-Open Application No. 91,014/74 discloses novel amorphous metals and amorphous metal articles. The component composition of the alloys is as follows.

The amorphous alloys have the following formula $$M_aY_bZ_c$$

wherein M is a metal selected from the group consisting of iron, nickel, chromium, cobalt and vanadium or a mixture thereof; Y is a metalloid selected from phosphorus, carbon and boron or a mixture thereof; Z is an element selected from the group consisting of aluminum, silicon, tin, antimony, germanium, indium and beryllium or a mixture thereof; a, b, and c are about 60–90 atomic%, 10–30 atomic% and 0.1–15 atomic% respectively, a+b+c being 100.

However, the amorphous alloys are ones containing 0.1–15 atomic% of an element selected from the group consisting of aluminum, silicon, tin, antimony, germanium, indium and beryllium or a mixture thereof as the essential component and have drawbacks in the cost of the starting material, the crystallizing temperature, the corrosion resistance, the embrittlement resistance and the like.

The inventors have already discovered Fe-Cr series amorphous alloys (Japanese Patent Laid-Open Application No. 101,215/75) and filed said patent application. The alloys are Fe-Cr series amorphous alloys having high strength, excellent corrosion resistance and heat resistance and consist of 1–40 atomic% of chromium, not less than 2 atomic% of boron, not less than 5 atomic% of phosphorus and 15–30 atomic% of the sum of carbon or boron and phosphorus and the remainder being iron. However, since these alloys contain boron, the cost of the starting material is high, and since these alloys contain phosphorus, the embrittlement resistance is low and when melting, vaporous phosphorus is generated and is harmful. Furthermore, the inventors have already discovered Fe-Cr series amorphous alloys (Japanese Patent Laid-Open Application No. 3,312/76) having high strength and filed this patent application. The alloys involve the following two kind of alloys.

(1) Fe-Cr series amorphous alloys having high strength and excellent heat resistance consisting of 1–40 atomic% of chromium, not less than 0.01% of each content of carbon and boron and the total amount being 7–35 atomic% and the remainder being iron.

(2) Fe-Cr series amorphous alloys having high strength and excellent heat resistance consisting of 1–40 atomic% of chromium, not less than 0.01 atomic% of each content of carbon and boron and the total amount of carbon and boron being 2–35 atomic%, not more than 33 atomic% of phosphorus, and the total amount of carbon, boron and phosphorus being 7–35 atomic% and the remainder being iron.

The above described alloys (1) and (2) are excellent in the heat resistance and high in the strength but since boron is contained, the cost of the starting material is high and the corrosion resistance is not satisfied, and since the alloys (2) contain phosphorus, the embrittlement resistance is low and when melting, the vaporous phosphorus is generated and this alloy is harmful.

Moreover, the inventors have discovered amorphous iron alloys (Japanese Patent Laid-Open Application No. 4,018/76) having high strength and filed such patent application. The alloys are as follows.

(1) Amorphous iron alloys having high strength consisting of 1–40 atomic% of chromium, not less than 2 atomic% of either carbon or boron, not less than 5 atomic% of phosphorus, the total amount of either carbon or boron, and phosphorus being 7–15 atomic% and the remainder being iron.

(2) Amorphous iron alloys having high strength consisting of 1–40 atomic% of chromium, not less than 2 atomic% of either carbon or boron, not less than 5 atomic% of phosphorus, the total amount of either carbon or boron and phosphorus being 30–35 atomic% and the remainder being iron.

The above described alloys (1) and (2) are high in the heat resistance and the mechanical strength but since phosphorus is contained in a relatively large amount, the vaporous phosphorus is generated upon melting and these alloys are harmful.

The inventors have found amorphous iron alloys (Japanese Patent Laid-Open Application No. 4,019/76) having high pitting corrosion resistance, crevice corrosion resistance, stress corrosion resistance and hydrogen embrittlement resistance and filed such patent application. The alloys are the following three kind of alloys.

(1) Amorphous iron alloys having high pitting corrosion resistance, crevice corrosion resistance, stress corrosion resistance and hydrogen embrittlement resistance and consisting of 1–40 atomic% of chromium, not less than 0.01% of each carbon and boron, the total amount being 7–35 atomic% and the remainder being iron.

(2) Amorphous iron alloys having high pitting corrosion resistance, crevice corrosion resistance, stress corrosion resistance and hydrogen embrittlement resistance and consisting of 1–40 atomic% of chromium, not less than 0.01 atomic% of each carbon and boron and the total amount being 2–35 atomic%, not more than 33 atomic% of phosphorus and the total amount of carbon, boron and phosphorus being 7–35 atomic%, and the remainder being iron.

(3) Amorphous iron alloys having high pitting corrosion resistance, crevice corrosion resistance, stress corrosion resistance and hydrogen embrittlement resistance and consisting of 1–40 atomic% of chromium, 2–30 atomic% of either carbon or boron, 5–33 atomic% of phosphorus, the total amount of either carbon or boron and phosphorus being 7–35 atomic% and the remainder being iron.

Among the above described alloys (1), (2) and (3), the alloys (1) and (2) contain boron and the alloys (2) and (3) contain phosphorus, so that the cost of the starting material is high or the embrittlement resistance is low and further the vaporous phosphorus is generated when melting and the alloys are harmful.

The inventors have disclosed amorphous alloys having high permeability and having the following component composition range in Japanese Patent Laid-Open Application No. 73,920/76.

(1) Amorphous alloys having high permeability and consisting of 7–35 atomic% of at least one of phosphorus, carbon and boron and 93–65 atomic% of at least one of iron and cobalt.

(2) Amorphous alloys having high permeability as described in the above described item (1), which further contains not more than 50 atomic% of the total amount of at least one component selected from the following groups (a), (b), (c), (d) and (e), (a) not more than 50 atomic% of nickel, (b) not more than 25 atomic% of silicon, (c) not more than 15 atomic% of at least one of chromium and manganese, (d) not more than 10 atomic% of at least one of molybdenum, zirconium, titanium, aluminum, vanadium, niobium, tantalum, tungsten, copper, germanium, beryllium and bismuth and (e) not more than 5 atomic% of at least one of praseodymium, neodymium, prometium, samarium, europium, gadolinium, terbium, dysprosium and holmium.

These alloys have not yet fully satisfied in view of the cost of the starting material, the crystallizing temperature, hardness, strength, embrittling temperature and the like.

Japanese Patent Laid-Open Application No. 5,620/77 discloses amorphous alloys containing iron group elements and boron. The amorphous alloys consist of the following component composition. At least 50% amorphous metal alloys having the following formula $$M_aM'_bCr_cM''_dB_e$$

wherein M is at least one element of iron, cobalt and nickel, M' is at least one element selected from the group consisting of iron, cobalt and nickel, which is different from the M element, M'' is at least one element selected from the group consisting of vanadium, manganese, molybdenum, tungsten, niobium and tantalum, a is about 40–85 atomic%, b is 0 to about 45 atomic%, c and d are 0–20 atomic% respectively and e is about 15–25 atomic%, provided that when M is nickel, all b, c and d do not become 0.

The alloys contain boron as the essential component, so that there is problem in view of the cost of the starting material and the crystallizing temperature.

The inventors have already discovered amorphous iron alloys having high strength, fatigue resistance, general corrosion resistance, pitting corrosion resistance, crevice corrosion resistance, stress corrosion resistance, and hydrogen embrittlement resistance and filed a patent application (Japanese Patent Laid-Open Application No. 4,017/76). These alloys contain 1–40 atomic% of chromium, and 7–35 atomic% of at least one of phosphorus, carbon and boron as the main component and as the auxiliary component, 0.01–75 atomic% of at least one group selected from the group consisting of (1) 0.01–40 atomic% of at least one of Ni and Co, (2) 0.01–20 atomic% of at least one of Mo, Zr, Ti, Si, Al, Pt, Mn and Pd, (3) 0.01–10 atomic% of at least one of V, Nb, Ta, W, Ge and Be, and (4) 0.01–5 atomic% of at least one of Au, Cu, Zn, Cd, Sn, As, Sb, Bi and S, and the remainder being substantially Fe.

The above described amorphous alloys are novel ones in which the strength and the heat resistant are improved and the corrosion resistance is provided by adding chromium. These alloys have excellent properties, for example, the fracture strength is within the range of about 1/40–1/50 of Young's modulus and is near the value of the ideal strength and in spite of the high strength, the toughness is very excellent and the fracture toughness value ($K_{IC}$) is about 5–10 times as high as the practically used high strength and tough steels (piano steel, maraging steel, PH steel and the like). More particularly, these alloys have novel properties in view of the corrosion resistance and have high resistance against not only the general corrosion, but also the pitting corrosion, crevice corrosion and stress corrosion, which cannot be avoided in the presently used stainless steels (304 steel, 316 steel and the like), but the component composition is broad, so that against the practical and novel use the heat resistance is high, and the hardness and strength are high and the embrittling temperature is high and the production is easy. The cheap component composition range has never been known.

The present invention aims to provide carbon series amorphous alloys which are easy and cheap in the production while holding the above described various properties and articles manufactured from said alloys.

DISCLOSURE OF INVENTION

The above described object of the present invention can be attained by providing carbon series amorphous alloys characterized in that said alloys have the component composition shown by the following formula and articles manufactured from the alloys.

$$X_aCr_bM_cQ_d$$

in the formula $X_a$ is a atomic% of at least one selected from Fe, Co and Ni, $Cr_b$ is b atomic%, Mc is c atomic% of at least one selected from Cr, Mo and W, $Q_d$ shows that carbon is contained in an amount of d atomic%, a is 14–86 atomic%, b is 0–22 atomic%, c is 4–38 atomic%, d is 10–26 atomic% and the sum of a, b, c and d is substantially 100 atomic%, and a part of M may be at least one element selected from the group (A) consisting of V, Ta and Mn, at least one element selected from the group (B) consisting of Nb, Ti and Zr, or a combination of at least one element selected from the above described group (A) and at least one element selected from the above described group (B) and the content of the group of V, Ta and Mn and the group of Nb, Ti and Zr is not more than 10 atomic% and not more than 5 atomic% respectively, or a part of Q may be N and the content of N is not more than 4 atomic%.

The inventors have found that iron group series alloys containing carbon (or a part of carbon is substituted with nitrogen) as the metalloid can easily form the amorphous products within a broad composition range and have excellent strength, hardness, corrosion resistance, embrittlement resistance and heat resistance; that a part of the alloys has high permeability and that a part of the alloys becomes non-magnetic, and the present invention has been accomplished.

The well known iron group series amorphous alloys are combination of at least one of iron group elements and a metalloid of P, B, Si and C, for example, $Fe_{70}Co_{10}P_{20}$, $Co_{80}B_{20}$, $Fe_{60}Co_{20}P_{12}B_8$, $Fe_{70}Ni_5Si_{15}B_{10}$, $Co_{60}Ni_{15}Si_{15}P_{10}$, $Fe_{70}Co_{10}P_{13}C_7$ and the like. However, the inventors have found that the metalloids which are the additives necessary for making these amorphous have different inherent properties. The effects are shown in Table 1. In said table, the properties are estimated by ◎ (excellent), o (good), × (passable).

TABLE 1

Effect of metalloid elements against various properties of amorphous iron group series alloys

| Properties | B | C | Si | P | Ge | Remarks |
|---|---|---|---|---|---|---|
| Cost of starting material | x | ◎ | o | ◎ | x | Higher cost in order Gel > B > Si > P > C |
| Harmfulness when melting | o | ◎ | ◎ | x | x | Particularly P is harmful |
| Amorphous alloy forming ability | o | ◎ | x | o | x | Easy in order C > B > P > Si > Ge |
| Crystallizing temperature | x | o | ◎ | x | x | Higher in order Si > C > B > P > Ge |
| Hardness, Strength | ◎ | ◎ | o | x | x | Increase in order B > C > Si > P > Ge |
| Corrosion resistance | x | o | x | ◎ | x | Higher in order P > C > B > Si > Ge |
| Embrittlement | o | ◎ | o | x | x | Higher resistance in order C > B > Si > P > Ge |

As seen from the above table, Ge is not preferable in all points and P is better in view of the cost of starting material and the corrosion resistance but is not preferable in the other points. Particularly, phosphorus generates harmful gas during melting and promotes the embrittlement of the material owing to heating, so that phosphorus is the element having many problems. In the above table, silicon and boron are not preferable, because these elements act to lower the corrosion resistance and boron has the defect that the cost of starting material becomes higher. It has been found that carbon is the element having the preferable properties in view of all points as seen from Table 1.

The inventors have made study in detail with respect to the iron group series amorphous alloys containing only carbon among the above described metalloids contributing to formation of amorphous alloys and the present invention has been accomplished.

BEST MODE OF CARRYING OUT THE INVENTION

Figure 1A:
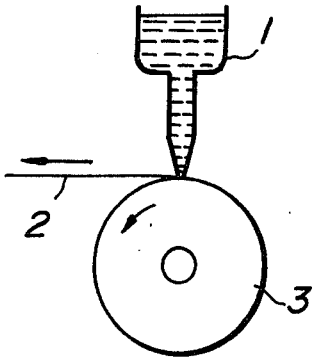
FIGS. 1(*a*) and (*b*) are schematical views of apparatuses for producing amorphous alloys by rapidly cooling a molten alloy.

In general, the amorphous alloys are obtained by rapidly cooling molten alloys and a variety of cooling processes have been proposed. For example, the process wherein a molten metal is continuously ejected on an outer circumferential surface of a disc (FIG. 1(*a*)) rotating at a high speed or between twin rolls (FIG. 1(*b*)) reversely rotating with each other at a high speed to rapidly cool the molten metal on the surface of the rotary disc or both rolls at a rate of about $10^{5°}$–$10^{6°}$ C./sec. and to solidify the molten metal, has been publicly known.

The amorphous iron group series alloys of the present invention can be similarly obtained by rapidly cooling the molten metal and by the above described various processes can be produced wire-shaped or sheet-shaped amorphous alloys of the present invention. Furthermore, amorphous alloy powders of about several μm–10 μm can be produced by blowing the molten metal on a cooling copper plate by a high pressure gas (nitrogen, argon gas and the like) to rapidly cool the molten metal in fine powder form, for example, by an atomizer. The alloy can substitute a part of carbon with not more than 4 atomic% of N as the metalloid. Accordingly, the expensive boron as in the conventional amorphous alloys is not used, so that the production cost is low and further the production is easy, so that the powders, wires or sheets composed of the amorphous alloys of the present invention can be advantageously produced in the commercial scale. Moreover, in the alloys of the present invention, even if a small amount of impurities present in the usual industrial materials, such as P, Si, As, S, Zn, Ti, Zr, Cu, Al and the like are contained, the object of the present invention can be attained.

The amorphous alloys according to the present invention are classified into the following groups in view of the component composition.

(a) (at least one of Fe, Co and Ni)-Cr-C,
(b) (at least one of Fe, Co and Ni)-Mo-C,
(c) (at least one of Fe, Co and Ni)-W-C,
(d) (at least one of Fe, Co and Ni)-Cr-W-C,
(e) (at least one of Fe, Co and Ni)-Mo-W-C,
(f) (at least one of Fe, Co and Ni)-Cr-Mo-W-C,
(a)′ (a)—(at least one of Mn, V, Ta, Nb, Ti and Zr),
(b)′ (b)—(at least one of Mn, V, Ta, Nb, Ti and Zr),
(c)′ (c)—(at least one of Mn, V, Ta, Nb, Ti and Zr),
(d)′ (d)—(at least one of Mn, V, Ta, Nb, Ti and Zr),
(e)′ (e)—(at least one of Mn, V, Ta, Nb, Ti and Zr),
(f)′ (f)—(at least one of Mn, V, Ta, Nb, Ti and Zr).

Then, an explanation will be made with respect to the reason of the limitation of the component composition in the present invention.

When, X, that is at least one of Fe, Co and Ni, is less than 14 atomic % or is more than 86 atomic%, no amorphous alloy is obtained, so that X must be 14–86 atomic%.

When Q is less than 10 atomic% or more than 26 atomic%, no amorphous alloy is obtained, so that Q must be 10–26 atomic%.

When b and c in $Cr_bM_c$ are beyond the ranges of 0–22 and 4–38 respectively, no amorphous alloy is obtained, so that b and c in $Cr_bM_c$ must be 0–22 and 4–38 respectively.

When a part of M is substituted with V, Ta or Mn, if at least one of V, Ta and Mn is more than 10 atomic%, or when a part of M is substituted with Nb, Ti or Zr, if at least one of Nb, Ti and Zr is more than 5 atomic%, no amorphous alloy is obtained, so that the group of V, Ta and Mn and the group of Nb, Ti and Zr must be not more than 10 atomic% and not more than 5 atomic% respectively.

When a part of Q is substituted with N, if N is more than 4 atomic%, N separates in the alloy structure as pores upon solidification owing to rapid cooling and the shape of the alloy is degraded and the mechanical strength lowers, so that N must be not more than 4 atomic%.

The component composition, crystallizing temperature Tx (°C.), hardness Hv (DPN) and fracture strength $\sigma_f$(kg/mm$^2$) are shown in Tables 2(a)-(e) and 3(a)-(d). The amorphous alloy samples are a ribbon shape having a thickness of 0.05 mm and a breadth of 2 mm produced by the single roll process as shown in FIG. 1, (*a*). The crystallizing temperature Tx is the initial exothermic peak starting temperature in the differential thermal curve when heating at 5° C./min and Hv is the measured value of a micro Vickers hardness tester of a load of 50 g. The mark (—) in the table shows that no measurement is made.

TABLE 2(a)

| Alloy | Crystallizing temperature Tx (°C.) | Hardness Hv (DPN) | Fracture strength $\sigma_f$ (kg/mm$^2$) |
|---|---|---|---|
| (a) Fe—Cr—C series | | | |
| $Fe_{56}Cr_{26}C_{18}$ | 465 | 930 | 310 |
| $Fe_{50}Cr_{32}C_{18}$ | 491 | 960 | 350 |
| $Fe_{46}Cr_{36}C_{18}$ | 515 | 980 | 385 |
| (b) Fe—Mo—C series | | | |
| $Fe_{78}Mo_6C_{16}$ | 380 | 830 | 280 |
| $Fe_{74}Mo_8C_{18}$ | 447 | 880 | 310 |
| $Fe_{64}Mo_{16}C_{20}$ | 565 | 890 | 360 |
| $Fe_{62}Mo_{20}C_{18}$ | 587 | 970 | 390 |
| (c) Fe—W—C series | | | |
| $Fe_{68}W_{10}C_{22}$ | 450 | 1,020 | 340 |
| $Fe_{66}W_{12}C_{22}$ | 481 | 1,020 | 350 |
| $Fe_{68}W_{12}C_{20}$ | 481 | 1,030 | 350 |
| $Fe_{66}W_{14}C_{20}$ | 520 | 1,050 | 380 |
| (d) Fe—Cr—Mo—C series | | | |
| $Fe_{170}Cr_4Mo_8C_{18}$ | 527 | 880 | 300 |
| $Fe_{62}Cr_{12}Mo_8C_{18}$ | 565 | 900 | 330 |
| $Fe_{54}Cr_{20}Mo_8C_{18}$ | 592 | 1,010 | 360 |
| $Fe_{46}Cr_{28}Mo_8C_{18}$ | 612 | 1,060 | 375 |
| $Fe_{42}Cr_{32}Mo_8C_{18}$ | 626 | 1,120 | 395 |
| $Fe_{46}Cr_{16}Mo_{20}C_{18}$ | 660 | 1,130 | 400 |
| $Fe_{59}Cr_{16}Mo_{10}C_{15}$ | 583 | 1,020 | 370 |

TABLE 2(b)

| Alloy | Crystallizing temperature Tx (°C.) | Hardness Hv (DPN) | Fracture strength $\sigma_f$ (kg/mm$^2$) |
|---|---|---|---|
| (e) Fe—Cr—W—C series | | | |
| $Fe_{65}Cr_{13}W_4C_{18}$ | 469 | 940 | 350 |
| $Fe_{61.5}Cr_{17}W_{5.5}C_{16}$ | 560 | 980 | 375 |
| $Fe_{67}Cr_{13}W_4C_{16}$ | 476 | 960 | 380 |
| $Fe_{63}Cr_{13}W_4C_{20}$ | 460 | 920 | 340 |
| (f) Fe—W—Mo—C series | | | |
| $Fe_{72}W_4Mo_8C_{16}$ | 526 | 910 | 350 |
| $Fe_{68}W_4Mo_8C_{20}$ | 537 | 990 | 375 |
| $Fe_{62}W_8Mo_{12}C_{18}$ | 552 | 1,050 | 390 |
| $Fe_{54}W_{16}Mo_{12}C_{18}$ | 571 | 1,100 | 405 |
| (g) Fe—Co—Mo—C series | | | |
| $Fe_{54}Co_{16}Mo_{12}C_{18}$ | 430 | 870 | 290 |
| $Fe_{35}Co_{35}Mo_{12}C_{18}$ | 418 | 840 | 280 |
| $Fe_{25}Co_{45}Mo_{12}C_{18}$ | 412 | 830 | 280 |
| (h) Fe—Ni—Mo—C series | | | |
| $Fe_{63}Ni_7Mo_{12}C_{18}$ | 466 | 890 | 310 |
| $Fe_{50}Ni_{20}Mo_{12}C_{18}$ | 420 | 830 | 290 |
| $Fe_{35}Ni_{35}Mo_{12}C_{18}$ | 381 | 820 | 280 |
| (i) Fe—Mo—Ta—C series | | | |
| $Fe_{66}Mo_{12}Ta_4C_{18}$ | 498 | 910 | 360 |
| $Fe_{64}Mo_{12}Ta_6C_{18}$ | 512 | 940 | 380 |

TABLE 2(c)

| Alloy | Crystallizing temperature Tx (°C.) | Hardness Hv (DPN) | Fracture strength $\sigma_f$ (kg/mm$^2$) |
|---|---|---|---|
| (j) Fe—Mo—V—C series | | | |
| $Fe_{66}Mo_{12}V_4C_{18}$ | 491 | 880 | 350 |
| $Fe_{62}Mo_{12}V_8C_{18}$ | 503 | 910 | 370 |
| (k) Fe—Mo—Mn—C series | | | |
| $Fe_{66}Mo_{12}Mn_4C_{18}$ | 489 | 870 | 350 |
| $Fe_{62}Mo_{12}Mn_8C_{18}$ | 496 | 900 | 360 |
| (l) Fe—Cr—Mo—W—C series | | | |
| $Fe_{59}Cr_{13}Mo_8W_4C_{16}$ | 589 | 1,020 | 385 |
| $Fe_{55}Cr_{13}Mo_8W_4C_{20}$ | 597 | 990 | 380 |
| (Other) | | | |
| $Fe_{67}Mo_{12}Mn_3V_2C_{16}$ | 495 | 870 | 370 |
| $Fe_{64}Mo_{12}Mn_4Ta_4C_{16}$ | 502 | 900 | 380 |
| $Fe_{65}Mo_{12}Ta_4V_3C_{16}$ | 504 | 900 | 380 |
| $Fe_{64}Mo_{12}Mn_4V_2Ta_2C_{16}$ | 511 | 920 | — |
| $Fe_{58}Co_8Mo_{12}Mn_6C_{16}$ | 476 | 830 | 340 |
| $Fe_{60}Co_8Mo_{12}V_4C_{16}$ | 480 | 850 | 350 |
| $Fe_{59}Co_8Mo_{12}Ta_5C_{16}$ | 494 | 870 | 360 |
| $Fe_{58}Ni_8Mo_{12}Mn_6C_{16}$ | 473 | 830 | 320 |
| $Fe_{60}Ni_8Mo_{12}V_4C_{16}$ | 477 | 850 | 320 |
| $Fe_{59}Ni_8Mo_{12}Ta_5C_{16}$ | 490 | 860 | 340 |

TABLE 2(d)

| Alloy | Crystallizing temperature Tx (°C.) | Hardness Hv (DPN) | Fracture strength $\sigma_f$ (kg/mm$^2$) |
|---|---|---|---|
| (Other) | | | |
| $Fe_{61}Co_6Mo_{12}Mn_3V_2C_{16}$ | 491 | 870 | — |
| $Fe_{59}Co_6Mo_{12}Mn_4Ta_3C_{16}$ | 499 | 890 | — |
| $Fe_{60}Co_6Mo_{12}Ta_4V_2C_{16}$ | 498 | 900 | — |
| $Fe_{58}Co_6Mo_{12}Mn_4V_2Ta_2C_{16}$ | 504 | 910 | — |
| $Fe_{61}Ni_6Mo_{12}Mn_3V_2C_{16}$ | 490 | 870 | — |
| $Fe_{59}Ni_6Mo_{12}Mn_4Ta_3C_{16}$ | 496 | 890 | — |
| $Fe_{60}Ni_6Mo_{12}Ta_4V_2C_{16}$ | 499 | 890 | — |
| $Fe_{58}Ni_6Mo_{12}Mn_4V_2Ta_2C_{16}$ | 501 | 910 | — |
| $Fe_{57}Co_6Cr_4Mo_{12}Mn_3V_2C_{16}$ | 500 | 910 | — |
| $Fe_{55}Co_6Cr_4Mo_{12}Mn_4Ta_3C_{16}$ | 506 | 920 | — |
| $Fe_{56}Co_6Cr_4Mo_{12}Ta_4V_2C_{16}$ | 507 | 920 | — |
| $Fe_{56}Ni_6Cr_6Mo_{12}Mn_2V_2C_{16}$ | 505 | 920 | — |
| $Fe_{56}Ni_6Cr_6Mo_{12}Mn_2Ta_2C_{16}$ | 511 | 920 | — |
| $Fe_{56}Ni_6Cr_6Mo_{12}Ta_2V_2C_{16}$ | 520 | 940 | — |
| $Fe_{70}Mo_{12}Nb_2C_{16}$ | 504 | 890 | 350 |
| $Fe_{68}Mo_{12}Nb_4C_{16}$ | 521 | 910 | — |
| $Fe_{70}Mo_{12}Ti_2C_{16}$ | 497 | 880 | 340 |
| $Fe_{68}Mo_{12}Ti_4C_{16}$ | 518 | 900 | — |
| $Fe_{70}Mo_{12}Zr_2C_{16}$ | 495 | 860 | 340 |
| $Fe_{68}Mo_{12}Zr_4C_{16}$ | 516 | 900 | — |

TABLE 2(e)

| Alloy | Crystallizing temperature Tx (°C.) | Hardness Hv (DPN) | Fracture strength $\sigma_f$ (kg/mm$^2$) |
|---|---|---|---|
| (Other) | | | |
| $Fe_{60}Co_8Mo_{12}Nb_4C_{16}$ | 507 | 870 | 360 |
| $Fe_{60}Co_8Mo_{12}Ti_4C_{16}$ | 502 | 850 | 340 |
| $Fe_{60}Co_8Mo_{12}Zr_4C_{16}$ | 500 | 840 | 330 |
| $Fe_{60}Ni_8Mo_{12}Nb_4C_{16}$ | 503 | 870 | — |
| $Fe_{60}Ni_8Mo_{12}Ti_4C_{16}$ | 499 | 850 | — |
| $Fe_{60}Ni_8Mo_{12}Zr_4C_{16}$ | 493 | 830 | — |

TABLE 3(a)

| Alloy | Crystallizing temperature Tx (°C.) | Hardness Hv (DPN) | Fracture strength $\sigma_f$ (kg/mm$^2$) |
|---|---|---|---|
| (a)' Co—Cr—C series | | | |

TABLE 3(a)-continued

| | Alloy | Crystallizing temperature Tx (°C.) | Hardness Hv (DPN) | Fracture strength $\sigma_f$ (kg/mm$^2$) |
|---|---|---|---|---|
| | $Co_{56}Cr_{26}C_{18}$ | 352 | 890 | 330 |
| | $Co_{40}Cr_{40}C_{20}$ | 473 | 970 | 360 |
| (b)' | Co—Mo—C series | | | |
| | $Co_{70}Mo_{12}C_{18}$ | 375 | 720 | 280 |
| | $Co_{44}Mo_{36}C_{20}$ | 596 | 1,190 | 390 |
| (c)' | Co—W—C series | | | |
| | $Co_{68}W_{12}C_{20}$ | 346 | 790 | 310 |
| | $Co_{66}W_{14}C_{20}$ | 362 | 840 | 320 |
| (d)' | Co—Cr—Mo—C series | | | |
| | $Co_{54}Cr_{12}Mo_{16}C_{18}$ | 510 | 920 | 340 |
| | $Co_{42}Cr_{20}Mo_{20}C_{18}$ | 623 | 1,080 | 360 |
| | $Co_{34}Cr_{28}Mo_{20}C_{18}$ | 664 | 1,400 | 410 |
| | $Co_{38}Cr_{20}Mo_{24}C_{18}$ | 638 | 1,380 | 370 |
| (e)' | Co—Cr—W—C series | | | |
| | $Co_{46}Cr_{20}W_{16}C_{18}$ | 573 | 1,380 | 410 |
| | $Co_{34}Cr_{40}W_8C_{18}$ | 596 | 1,430 | — |
| (f)' | Co—Mo—W—C series | | | |
| | $Co_{46}Mo_{32}W_4C_{18}$ | 590 | 1,310 | 370 |
| | $Co_{50}Mo_{24}W_8C_{18}$ | 614 | 1,380 | 390 |

TABLE 3(b)

| | Alloy | Crystallizing temperature Tx (°C.) | Hardness Hv (DPN) | Fracture strength $\sigma_f$ (kg/mm$^2$) |
|---|---|---|---|---|
| (g)' | Co—Cr—Mo—W—C series | | | |
| | $Co_{26}Cr_{24}Mo_{24}W_8C_{18}$ | 721 | 1,470 | — |
| | $Co_{34}Cr_{20}Mo_{20}W_8C_{18}$ | 683 | 1,420 | 410 |
| (h)' | Ni—Cr—Mo—C series | | | |
| | $Ni_{42}Cr_{16}Mo_{24}C_{18}$ | 497 | 960 | 340 |
| | $Ni_{34}Cr_{24}Mo_{24}C_{18}$ | 558 | 1,060 | 350 |
| (i)' | Ni—Cr—Mo—W—C series | | | |
| | $Ni_{38}Cr_{20}Mo_{20}W_4C_{18}$ | 612 | 1,120 | 350 |
| | $Ni_{30}Cr_{24}Mo_{20}W_8C_{18}$ | 631 | 1,170 | 350 |
| (j)' | Ni—Cr—W—C series | | | |
| | $Ni_{54}Cr_{16}W_{12}C_{18}$ | 437 | 910 | 340 |
| | $Ni_{34}Cr_{28}W_{20}C_{18}$ | 547 | 1,080 | 360 |
| | $Ni_{54}Mo_{20}W_8C_{18}$ | 521 | 1,070 | 360 |
| (k)' | Ni—Cr—(V,Mn,Ta)—C series | | | |
| | $Ni_{46}Cr_{28}V_8C_{18}$ | 470 | 930 | — |
| | $Ni_{46}Cr_{28}Mn_8C_{18}$ | 461 | 930 | — |
| | $Ni_{46}Cr_{32}Ta_4C_{18}$ | 487 | 950 | — |

TABLE 3(c)

| | Alloy | Crystallizing temperature Tx (°C.) | Hardness Hv (DPN) | Fracture strength $\sigma_f$ (kg/mm$^2$) |
|---|---|---|---|---|
| (l)' | $Co_4Fe_{66}Mo_{12}C_{18}$ | 489 | 940 | 320 |
| | $Co_{16}Fe_{54}Mo_{12}C_{18}$ | 447 | 870 | 290 |
| | $Co_{50}Fe_{20}Mo_{12}C_{18}$ | 412 | 830 | 280 |
| | $Co_{60}Ni_{10}Mo_{12}C_{18}$ | 373 | 710 | 280 |
| | $Co_{35}Ni_{35}Mo_{12}C_{18}$ | 370 | 700 | 280 |
| | $Fe_{63}Ni_7Mo_{12}C_{18}$ | 466 | 890 | 310 |
| | $Fe_{35}Ni_{35}Mo_{12}C_{18}$ | 381 | 820 | 280 |
| | $Fe_{30}Co_{20}Ni_{20}Mo_{12}C_{18}$ | 461 | 890 | 300 |
| (m)' | $Co_{50}Fe_8Cr_8Mo_{16}C_{18}$ | 427 | 910 | — |
| | $Co_{30}Fe_{28}Cr_8Mo_{16}C_{18}$ | 448 | 930 | — |
| | $Co_{50}Ni_8Cr_8Mo_{16}C_{18}$ | 416 | 910 | — |
| | $Co_{30}Ni_{28}Cr_8Mo_{16}C_{18}$ | 405 | 900 | — |
| | $Fe_{50}Ni_{18}Cr_8Mo_{16}C_{18}$ | 543 | 930 | — |
| | $Fe_{30}Ni_{28}Cr_8Mo_{16}C_{18}$ | 522 | 920 | — |
| | $Co_{20}Fe_{19}Ni_{19}Cr_8Mo_{16}C_{18}$ | 531 | 910 | — |

TABLE 3(c)-continued

| | Alloy | Crystallizing temperature Tx (°C.) | Hardness Hv (DPN) | Fracture strength $\sigma_f$ (kg/mm$^2$) |
|---|---|---|---|---|
| | $Co_{44}Fe_{10}Cr_8Mo_{16}W_4C_{18}$ | 548 | 940 | — |

TABLE 3(d)

| | Alloy | Crystallizing temperature Tx (°C.) | Hardness Hv (DPN) | Fracture strength $\sigma_f$ (kg/mm$^2$) |
|---|---|---|---|---|
| (n)' | $Co_{40}Fe_{10}Cr_8Mo_{16}W_4V_4C_{18}$ | 561 | 960 | — |
| | $Co_{40}Fe_{10}Cr_8Mo_{16}W_4Mn_4C_{18}$ | 557 | 950 | — |
| | $Co_{40}Fe_4Cr_{30}V_8C_{18}$ | 482 | 930 | — |
| | $Co_{38}Fe_{10}Cr_{26}Mn_8C_{18}$ | 475 | 910 | — |
| | $Co_{50}Fe_8Mo_{16}V_8C_{18}$ | 486 | 970 | — |
| | $Co_{50}Fe_{16}Mo_{12}Mn_4C_{18}$ | 421 | 880 | — |
| | $Co_{46}Fe_8Cr_8Mo_{12}W_4Ta_4C_{18}$ | 497 | 990 | — |

In general, the amorphous alloys are crystallized by heating and the ductility and toughness which are the characteristics of the amorphous alloys are lost and further the other excellent properties are deteriorated, so that the alloys having high Tx are practically advantageous. Tx of the amorphous alloys of the present invention is about 350°–650° C. in the major part as seen from Tables 2(a)–(e) and 3(a)–(d) and it can be seen that as the content of Cr, Mo, W, V, Ta and Mn increases, Tx tends to rise, so that the alloys of the present invention have high Tx and are stable against heat. The hardness (Hv) and the fracture strength ($\sigma_f$) are 800–1,100 DPN and 280–400 kg/mm$^2$ respectively and as the content of Cr, Mo, W, V, Ta and Mn increases, both the values increase. These values are equal to or more than the heretofore known maximum value (in the case of Fe-B series alloys, Hv=1,100 DPN, $\sigma_f$=330 kg/mm$^2$) and the alloys have excellent hardness and strength. Namely, in (c) Fe-W-C series in Table 2, the alloys containing 10–14 atomic% of W have a hardness of more than 1,000 DPN, and in (d) Fe-Cr-Mo-C series in the same table, the hardness is more than 1,000 DPN, the crystallizing temperature exceeds 600° C. and the fracture strength reaches 400 kg/mm$^2$.

In Co-Cr-C series, when Cr is not less than 40 atomic%, the alloys having Tx of higher than 500° C. and Hv of more than 1,000 DPN are obtained.

In Co-Mo-C series, when Mo is not less than 30 atomic%, the alloys having Tx of higher than 550° C. and Hv of more than 1,000 DPN are obtained.

The comparison of the (a)' series alloys with the (b)' series alloys shows that both Tx and Hv are considerably improved by combination function of Cr and Mo in addition to Co-C. When Cr is not less than 20 atomic% and Mo is not less than 20 atomic%, the alloys having Tx of higher than 600° C. and Hv of more than 1,200 DPN are easily obtained.

From the comparison of (a)' series alloys with (e)' series alloys, it can be seen that the addition of Cr and W to Co-C highly improves Hv and $\sigma_f$.

The comparison of (f)' series alloys with (g)' series alloys shows that the combination addition of Mo-W-Cr more improves all Tx, Hv and $\sigma_f$ than the addition of Mo-W.

The comparison of (h)′ series alloys with (i)′ series alloys shows that the use of W in addition to Cr-Mo considerably improves Tx and Hv.

The comparison of (j)′ series alloys with (k)′ series alloys shows that V, Mn and Ta have the same effect as in W and Mo.

Moreover, it has been newly found that the alloys wherein X is at least one of Fe, Co and Ni and a is 14–66 atomic%, b is 10–22 atomic%, c is 10–38 atomic% and d is 14–26 atomic%, have high strength, hardness and crystallizing temperature.

Furthermore, it has been found that the alloys wherein a part of M in the above described alloy composition is not more than 10 atomic% of at least one element selected from the group (A) consisting of Ta, Mn and V or not more than 5 atomic% of at least one element selected from the group (B) consisting of Nb, Ti and Zr, or a combination of at least one element selected from the group (A) and at least one element selected from the group (B), have high strength, hardness and crystallizing temperature.

It has been known that the amorphous alloys generally become brittle at a lower temperature range than the crystallizing temperature. According to the inventors' study, it has been found that the embrittlement of the above described amorphous iron group series alloys greatly depends upon the content and the kind of the metalloid contained in the alloys. The result comparing the embrittling temperature of amorphous iron group series alloys containing various metalloids with that of the amorphous iron group series alloys containing C according to the present invention is shown in Table 4(a)–(b).

TABLE 4(a)

| | Embrittlement of alloys of present invention owing to heating | | | |
|---|---|---|---|---|
| | Composition | Embrittling temperature Tf (°C.) | Composition | Embrittling temperature Tf (°C.) |
| Present invention | $Fe_{50}Cr_{32}C_{18}$ | 310 | $Ni_{38}Cr_{20}Mo_{20}W_4C_{18}$ | 350 |
| | $Fe_{62}Mo_{20}C_{18}$ | 290 | $Co_{50}Fe_{20}Mo_{12}C_{18}$ | 410 |
| | $Fe_{66}W_{12}C_{22}$ | 290 | $Co_{16}Fe_{54}Mo_{12}C_{18}$ | 320 |
| | $Fe_{59}Cr_{16}Mo_{10}C_{15}$ | 350 | $Co_6Fe_{64}Mo_{12}C_{18}$ | 310 |
| | $Fe_{42}Cr_{32}Mo_8C_{18}$ | 310 | $Co_{60}Ni_{10}Mo_{12}C_{18}$ | 380 |
| | $Fe_{61.5}Cr_{17}W_{5.5}C_{16}$ | 340 | $Co_{35}Ni_{35}Mo_{12}C_{18}$ | 360 |
| | $Fe_{72}Mo_8W_4C_{16}$ | 410 | $Fe_{63}Ni_7Mo_{12}C_{18}$ | 320 |
| | $Fe_{55}Cr_{13}Mo_8W_4C_{20}$ | 300 | $Fe_{35}Ni_{35}Mo_{12}C_{18}$ | 320 |
| | $Fe_{52}Co_{16}Mo_{14}C_{18}$ | 350 | $Fe_{40}Co_{10}Cr_{24}V_8C_{18}$ | 300 |
| | $Fe_{61}Ni_7Mo_{14}C_{18}$ | 340 | $Fe_{40}Ni_{10}Cr_{24}V_8C_{18}$ | 310 |
| | $Co_{50}Cr_{32}C_{18}$ | 410 | $Fe_{40}Co_{10}Cr_{24}Mn_8C_{18}$ | 320 |
| | $Co_{58}Mo_{24}C_{18}$ | 440 | $Fe_{40}Ni_{10}Cr_{24}Mn_8C_{18}$ | 320 |

TABLE 4(b)

| | Embrittlement of alloys of present invention owing to heating | | | | |
|---|---|---|---|---|---|
| | Composition | Embrittling temperature Tf (°C.) | | Composition of conventional iron series alloys | Embrittling temperature Tf (°C.) |
| Present invention | $Co_{46}Mo_{36}C_{18}$ | 400 | Comparative Example | $Fe_{80}P_{13}C_7$ | 290 |
| | $Co_{70}W_{12}C_{18}$ | 380 | | $Fe_{78}Si_{10}B_{12}$ | 300 |
| | $Co_{62}Cr_8Mo_{12}C_{18}$ | 450 | | $Fe_{85}B_{15}$ | 320 |
| | $Co_{54}Cr_{12}Mo_{16}C_{18}$ | 420 | | $Fe_{60}B_{20}$ | 350 |
| | $Co_{46}Cr_{20}W_{16}C_{18}$ | 400 | | $Fe_{80}P_{20}$ | 240 |
| | $Co_{34}Cr_{40}W_8C_{18}$ | 370 | | | |
| | $Co_{46}Mo_{32}W_4C_{18}$ | 370 | | | |
| | $Co_{34}Cr_{20}Mo_{20}W_8C_{18}$ | 340 | | | |
| | $Ni_{42}Cr_{16}Mo_{24}C_{18}$ | 390 | | | |
| | $Ni_{34}Cr_{24}Mo_{24}C_{18}$ | 380 | | | |
| | $Ni_{54}Cr_{16}W_{12}C_{18}$ | 390 | | | |
| | $Ni_{34}Cr_{28}W_{20}C_{18}$ | 370 | | | |
| | $Ni_{54}Mo_{20}W_8C_{18}$ | 370 | | | |

The embrittling temperature shown in the table shows the temperature at which 180° bending when heating at each temperature for 30 minutes is feasible and it means that as this temperature is higher, the embrittling tendency is low. As seen in the table, the alloys containing P are noticeable in the embrittlement but the major part of the alloys of the present invention has higher embrittling temperature than $Fe_{80}B_{20}$ alloy which has heretofore been known as the alloy which is hardly embrittled.

In the alloys of the present invention, Co or Ni base amorphous alloys show higher embrittling temperatures than Fe base amorphous alloys. The smaller the content of Cr, Mo, W and the like in the alloys, the higher the embrittling temperature is. In the alloys of the present invention, when X is Ni alone or Ni and Co, not only are the corrosion resistance and the toughness more improved than the alloys wherein X is Fe alone, but also the production (forming ability) becomes more easy.

Particularly, Ni base alloys readily provide thick products and the embrittling temperature becomes higher.

It has been found that in the alloys according to the present invention, the alloys wherein X consists of Ni and/or Co and Fe and have the following formula $$X_a=[(Ni, Co)_{1-\beta}Fe_\beta]_a$$

wherein $\beta$ is 0–0.30 atomic%, a is 38–86 atomic%, and b is 0–22 atomic%, c is 4–20 atomic% and d is 10–20, are higher 150° C. in the embrittling temperature than Fe base alloys and their workability, punchability and rolling ability are improved. The alloys having such properties do not become brittle even by raising temperature in an inevitable heat treatment and production, when said alloys are used for tool materials, such as blades, saws and the like, hard wires, such as tire cords, wire ropes and the like, composite materials of synthetic resins, such as vinyls, rubbers and the like, and composite materials to be used together with low melting metals, such as aluminum, so that such alloys are advantageous. Furthermore, such alloys are useful for magnetic materials.

The inventors have found that nitrogen has substantially the same functional effect as carbon in the amorphous alloy forming ability and their properties and a part of carbon in the alloy composition of the present invention can be substituted with nitrogen. Namely a part of C constructing Q of the alloys of the present invention may be substituted with not more than 4 atomic% of N. However, nitrogen is a gaseous element, so that when nitrogen is added in an amount of more than equilibrium absorbing amount of the molten alloy, nitrogen separates in the alloy structure as pores when being solidified by rapidly cooling and deteriorates the alloy shape reduces its mechanical strength so that the addition of more than 4 atomic% of nitrogen is not advantageous. Table 5(a)–(c) shows the component composition and various properties of the amorphous alloys containing nitrogen.

TABLE 5(a)

| Composition | Properties of alloys of present invention containing nitrogen: Crystallizing temperature Tx (°C.) | Hardness Hv (DPN) | Fracture strength $\sigma_f$ (kg/mm$^2$) | Embrittling temperature Tf (°C.) |
|---|---|---|---|---|
| $Fe_{56}Cr_{26}C_{16}N_2$ | 452 | 910 | — | — |
| $Fe_{78}Mo_6C_{14}N_2$ | 395 | 850 | 270 | 310 |
| $Fe_{62}Mo_{20}C_{14}N_4$ | 575 | 960 | 380 | 280 |
| $Fe_{68}W_{12}C_{18}N_2$ | 501 | 980 | — | — |
| $Fe_{70}Cr_4Mo_8C_{16}N_2$ | 531 | 860 | — | — |
| $Fe_{54}Cr_{20}Mo_8C_{14}N_4$ | 610 | 1,010 | 340 | 330 |
| $Fe_{65}Cr_{13}W_3C_{16}N_2$ | 472 | 955 | — | — |
| $Fe_{72}W_4Mo_8C_{14}N_2$ | 550 | 1,000 | 360 | 390 |
| $Fe_{62}W_8Mo_{12}C_{16}N_2$ | 574 | 1,110 | 405 | 350 |
| $Fe_{59}Cr_{13}Mo_8W_4C_{14}N_2$ | 601 | 1,080 | 390 | 370 |
| $Fe_{54}Cr_{20}Mo_4W_4C_{14}N_4$ | 650 | 1,170 | — | — |

TABLE 5(b)

| | Properties of alloys of present invention containing nitrogen: Crystallizing temperature Tx (°C.) | Hardness Hv (DPN) | Fracture strength $\sigma_f$ (kg/mm$^2$) | Embrittling temperature Tf (°C.) |
|---|---|---|---|---|
| $Co_{56}Cr_{26}C_{16}N_2$ | 364 | 910 | 330 | 400 |

TABLE 5(b)-continued

| | Properties of alloys of present invention containing nitrogen: Crystallizing temperature Tx (°C.) | Hardness Hv (DPN) | Fracture strength $\sigma_f$ (kg/mm$^2$) | Embrittling temperature Tf (°C.) |
|---|---|---|---|---|
| $Co_{68}Mo_{16}C_{14}N_2$ | 410 | 750 | 280 | 450 |
| $Co_{66}Mo_{16}C_{14}N_4$ | 430 | 770 | 300 | 410 |
| $Co_{70}W_{12}C_{16}N_2$ | 348 | 820 | 290 | 380 |
| $Co_{54}Cr_{12}Mo_{16}C_{16}N_2$ | 516 | 930 | 360 | 400 |
| $Co_{42}Cr_{20}Mo_{20}C_{16}N_2$ | 638 | 1,130 | 370 | 340 |
| $Co_{46}Cr_{20}W_{16}C_{16}N_2$ | 584 | 1,410 | 410 | 320 |
| $Co_{46}Mo_{32}W_4C_{16}N_2$ | 596 | 1,370 | 380 | 320 |
| $Co_{50}Mo_{24}W_8C_{16}N_2$ | 621 | 1,410 | 400 | 330 |
| $Ni_{42}Cr_{16}Mo_{24}C_{16}N_2$ | 507 | 990 | 350 | 380 |
| $Ni_{54}Cr_{16}W_{12}C_{16}N_2$ | 441 | 930 | 340 | 400 |
| $Ni_{54}Mo_{20}W_8C_{16}N_2$ | 525 | 1,080 | 360 | 390 |
| $Co_{16}Fe_{54}Mo_{12}C_{16}N_2$ | 434 | 880 | 290 | 310 |
| $Co_{50}Fe_{20}Mo_{12}C_{16}N_2$ | 418 | 840 | 280 | 390 |
| $Co_{60}Ni_{10}Mo_{12}C_{16}N_2$ | 378 | 730 | 290 | 360 |
| $Co_{60}Ni_{10}Mo_{12}C_{14}N_4$ | 389 | 740 | 300 | 340 |
| $Fe_{35}Ni_{35}Mo_{12}C_{16}N_2$ | 386 | 840 | 290 | 300 |
| $Fe_{35}Ni_{35}Mo_{12}C_{14}N_4$ | 391 | 850 | 300 | 300 |
| $Fe_{30}Co_{20}Ni_{20}Mo_{12}C_{16}N_2$ | 470 | 910 | 320 | 320 |

TABLE 5(c)

| | Properties of alloys of present invention containing nitrogen: Crystallizing temperature Tx (°C.) | Hardness Hv (DPN) | Fracture strength $\sigma_f$ (kg/mm$^2$) | Embrittling temperature Tf (°C.) |
|---|---|---|---|---|
| $Co_{50}Fe_8Cr_8Mo_{16}C_{16}N_2$ | 431 | 930 | 330 | 340 |
| $Co_{50}Fe_8Cr_8Mo_{16}C_{14}N_4$ | 437 | 950 | 350 | 340 |
| $Co_{50}Ni_8Cr_8Mo_{16}C_{16}N_2$ | 420 | 920 | 310 | 360 |
| $Fe_{50}Ni_{18}Cr_8Mo_{16}C_{16}N_2$ | 551 | 930 | 340 | 310 |

As seen from the comparison of Table 5(a)–(c) with Tables 2(a)–(c), 3(a)–(d) and 4(a)–(b) various properties of the alloys wherein a part of carbon is substituted with nitrogen do not substantially vary from those of the alloys not containing nitrogen and these alloys show excellent properties in all the crystallizing temperature, hardness, fracture strength and embrittling temperature.

The alloys of the present invention are highly strong materials having surprising hardness and strength as mentioned above and are far higher than hardness of 700–800 DPN and fracture strength of 250–300 kg/mm$^2$ of a piano wire which is a representative of heretofore known high strength steels. In general, it is difficult to manufacture wires and sheets from high strength steels and complicated production steps (melting→casting→normalizing→forging, rolling→annealing) are needed but the alloys of the present invention can produce directly the final products of wires and sheets immediately after melting and this is a great advantage. Accordingly, the amorphous alloys of the present invention have a large number of uses, for example tool materials, such as blades, saws and the like, hard wire materials, such as tire cords, wire ropes and the like, composite materials to organic or inorganic materials, reinforcing materials for vinyls, plastics, rubbers, aluminum, concrete and the like, mix-spinning materials (safety working clothes, protective tent, ultra-high frequency wave protecting clothes, microwave absorption plate, thield sheets, conductive tape, operating clothes, antistatic stocking, carpet, belt, and the like), public nuisance preventing filter, screen, magnetic materials and the like.

Figure 1B:
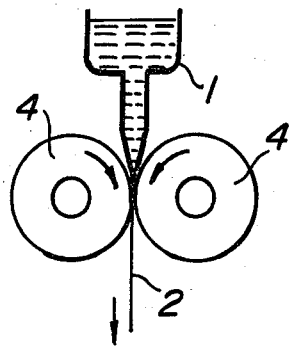

It has been newly found that the alloys of the present invention wherein a is 14–84 atomic%, b is 2–22 atomic%, c is 4–38 atomic% and d is 10–26 atomic%, are particularly excellent in the corrosion resistance. Table 6 shows the results when the corrosion test wherein ribbon-shaped alloys having a thickness of 0.05 mm and a breadth of 2 mm produced by the twin roll process shown in FIG. 1(b) are immersed in 1 N aqueous solution of $H_2SO_4$, HCl and NaCl at 30° C. for one week, was carried out.

TABLE 6

| | Alloy | Result of corrosion test: Corrosion rate ($mg/cm^2/year$) 1N $H_2SO_4$ 30° C. | 1N HCl 30° C. | 1N NaCl 30° C. |
|---|---|---|---|---|
| Present invention | $Fe_{76}Cr_6C_{18}$ | 1.5 | 3.2 | 3.0 |
| | $Fe_{72}Cr_{10}C_{18}$ | 0.00 | 0.05 | 0.1 |
| | $Fe_{62}Cr_{20}C_{18}$ | 0.00 | 0.00 | 0.00 |
| | $Fe_{62}Cr_{40}C_{18}$ | 0.00 | 0.00 | 0.00 |
| | $Fe_{74}Cr_2Mo_6C_{18}$ | 0.00 | 0.00 | 0.00 |
| | $Fe_{54}Cr_{10}Mo_{16}C_{20}$ | 0.00 | 0.00 | 0.00 |
| | $Fe_{74}Cr_2W_6C_{18}$ | 0.00 | 0.00 | 0.00 |
| | $Fe_{54}Cr_{10}W_{16}C_{20}$ | 0.00 | 0.00 | 0.00 |
| | $Fe_{76}Cr_2Mo_2W_2C_{18}$ | 0.00 | 0.00 | 0.00 |
| | $Fe_{60}Cr_{10}Mo_8W_4C_{18}$ | 0.00 | 0.00 | 0.00 |
| | $Fe_{60}Ni_{10}Mo_{12}C_{18}$ | 1.6 | 2.8 | 2.7 |
| | $Fe_{60}Co_{10}Mo_{12}C_{18}$ | 1.9 | 3.4 | 3.1 |
| | $Fe_{70}Co_{10}Ni_{10}Mo_{12}C_{18}$ | 1.1 | 2.4 | 2.1 |
| | $Fe_{56}Cr_6Ni_{10}Co_{10}C_{18}$ | 0.46 | 0.87 | 0.74 |
| | $Co_{56}Cr_{26}C_{18}$ | 0.00 | 0.00 | 0.00 |
| | $Co_{46}Ni_{10}Cr_{26}C_{18}$ | 0.00 | 0.00 | 0.00 |
| | $Co_{46}Fe_{10}Cr_{26}C_{18}$ | 0.00 | 0.00 | 0.00 |
| | $Co_{36}Fe_{10}Ni_{10}Cr_{26}C_{18}$ | 0.00 | 0.00 | 0.00 |
| | $Co_{70}Mo_{12}C_{18}$ | 1.3 | 2.9 | 2.6 |
| | $Co_{68}Cr_2Mo_{12}C_{18}$ | 0.00 | 0.06 | 0.02 |
| | $Co_{60}Cr_{10}Mo_{12}C_{18}$ | 0.00 | 0.00 | 0.00 |
| | $Co_{60}Cr_{10}W_{12}C_{18}$ | 0.00 | 0.00 | 0.00 |
| | $Ni_{46}Cr_{12}Mo_{24}C_{18}$ | 0.00 | 0.00 | 0.00 |
| | $Ni_{46}Cr_{20}W_{16}C_{18}$ | 0.00 | 0.00 | 0.00 |
| Comparative alloys | 13% Cr steel | 515 | 600 | 451 |
| | 304 Steel | 25.7 | 50 | 22 |
| | 316 L steel | 8.6 | 10 | 10 |

For comparison, the similar test was carried out with respect to commercially available 13% Cr steel, 18–8 stainless steel (AISI 304 steel), 17–14–2.5 Mo stainless steel (AISI 316L steel).

As seen from this table, the iron group series amorphous alloys of the present invention are more excellent in the corrosion resistance against all the solutions than the commercially available steels.

Furthermore, the alloys wherein X is a combination of at least one of Co and Ni with Fe, more improve the corrosion resistance than the alloys wherein X is Fe alone.

Figure 2:
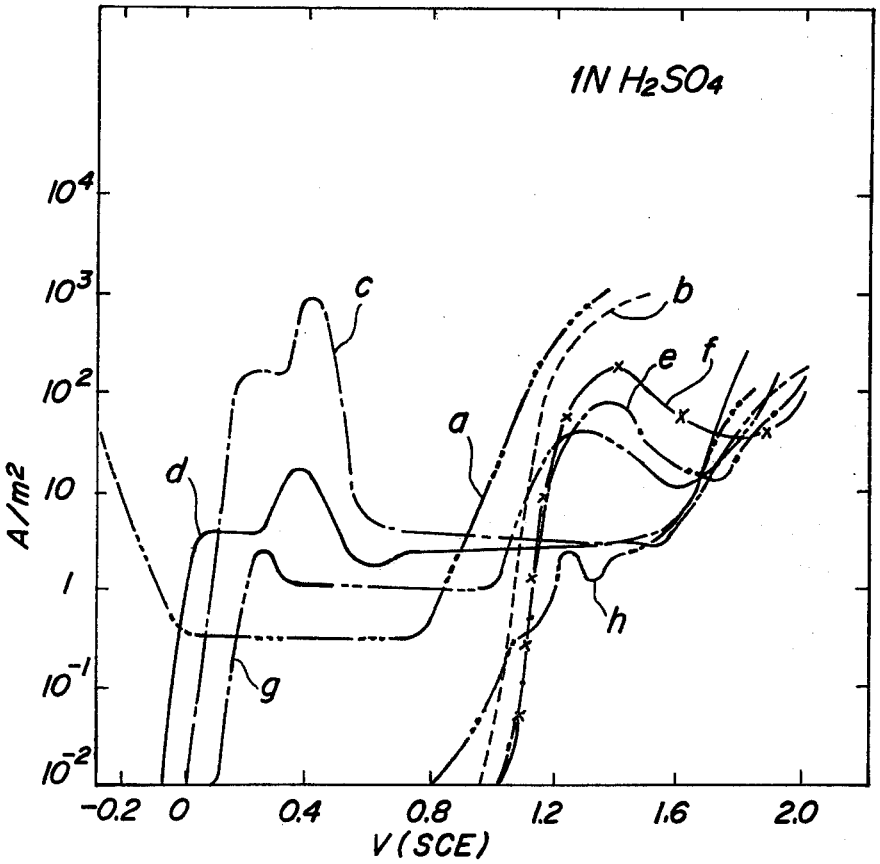
FIG. 2 is the polarization curve of the alloys of the present invention in 1 N aqueous solution of $H_2SO_4$.
Figure 3:
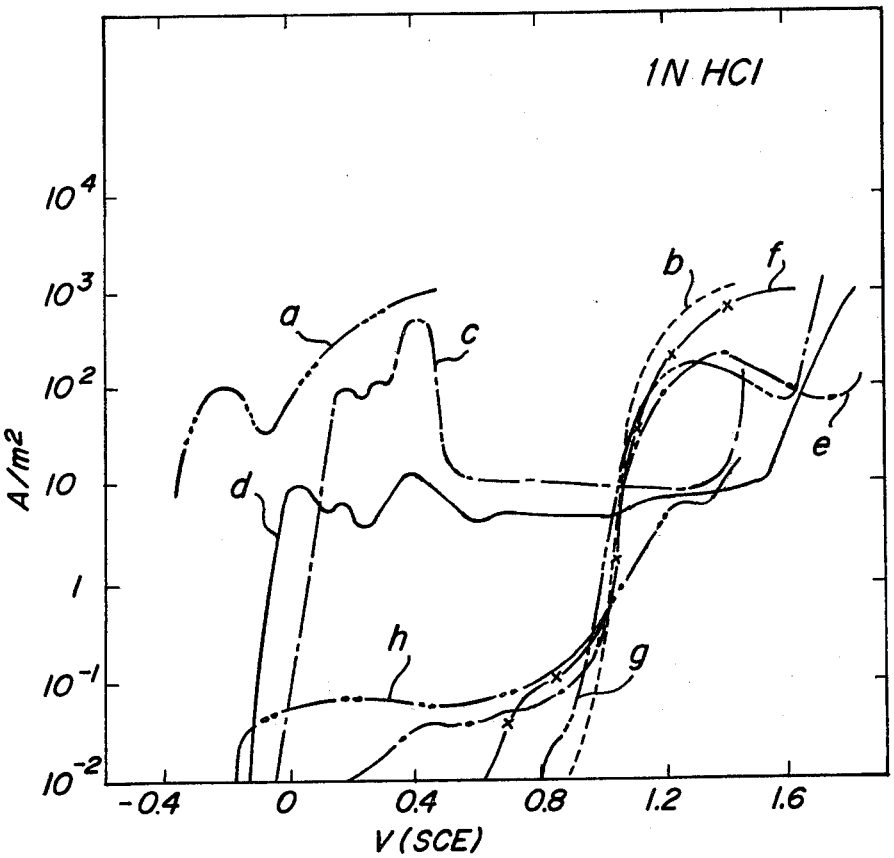
FIG. 3 is the polarization curve of the alloys of the present invention in 1 N aqueous solution of HCl.

For determining the electrochemical properties of the amorphous alloys, the polarization curve was measured by a potentiostatic method (constant potential process). FIGS. 2 and 3 show the polarization curves with respect to several amorphous iron alloys and the comparative $Fe_{63}Cr_{17}P_{13}C_7$ amorphous alloys and AISI 304 steel immersed in each of 1 N aqueous solution of $H_2SO_4$ and 1 N aqueous solution of HCl. In 1 N aqueous solution of $H_2SO_4$ (at room temperature) in FIG. 2, AISI 304 steel is high in the current density in active range and is narrow in the passivation potential, while the alloys of the present invention containing Cr are completely passivative until the potential of 1.0 V (S.C.E.) and dissolve off Cr in the alloy at the potential of more than 1.0 V and show the ideal polarization behavior. On the other hand, $Fe_{68}Mo_{16}C_{16}$ amorphous alloy of the present invention containing no Cr shows the similar behavior to AISI 304 steel, but is broad in the passivation region and is stable until the oxygen generating potential of more than 1.5 V. In 1 N aqueous solution of HCl in FIG. 3, the more noticeable difference can be observed. As well known, AISI 304 steel does not become passivative at the potential more than the active range and increases the current density due to the pitting corrosion but the amorphous alloys of the present invention do not cause pitting corrosion but becomes passivative. These experimental results coincide with the immersion results in Table 6.

As seen from the above described results, the amorphous alloys of the present invention are more excellent $10^3$–$10^5$ times as high as the commercially available high class stainless steels in the corrosion resistance and are unexpectedly higher corrosion resistant materials and can be utilized for wires and sheets to be used under severe corrosive atmosphere. For example, the amorphous alloys may be used for filter or screen materials, sea water resistant materials, chemical resistant materials, electrode materials and the like instead of stainless steel fibers which have been presently broadly used.

It has been newly found that the amorphous alloys wherein X is Fe and Co, a is 54–86 atomic%, b is 0 atomic%, c is 4–20 atomic%, d is 10–26 atomic%, and the amorphous alloys wherein not more than 10 atomic% of Ni is contained as a part of X have high permeability. Table 7(a)–(b) shows the comparison of the alloys of the present invention having soft magnetic properties with the commercially available magnetic alloys.

The alloys of the present invention have the same magnetic properties as the amorphous alloys having high permeability described on the above described Japanese Patent Laid-Open Application No. 73,920/76. In addition, the alloys of the present invention are low in the cost of the starting materials and are excellent in the crystallizing temperature, hardness, strength, embrittling temperature and the like and are novel alloys having high permeability.

TABLE 7(a)

| Alloy | Magnetic properties of alloys of present invention and commercially available alloys: Saturation magnetic flux density Bs (Gauss) | Coercive force Hc (Oersted) | Initial permeability ($\mu o$) | Curie temperature Tc (°C.) | Specific resistance $\rho$ ($\Omega \cdot cm$) |
|---|---|---|---|---|---|
| $Fe_{78}Mo_4C_{18}$ | 12,000 | 0.10 | 30,000 | 360 | $185 \times 10^{-6}$ |
| $Fe_{74}Mo_8C_{18}$ | 10,350 | 0.05 | 42,000 | 250 | $190 \times 10^{-6}$ |

TABLE 7(a)-continued

| | Alloy | Magnetic properties of alloys of present invention and commercially available alloys: Saturation magnetic flux density Bs (Gauss) | Coercive force Hc (Oersted) | Initial permeability (μo) | Curie temperature Tc (°C.) | Specific resistance ρ (Ω . cm) |
|---|---|---|---|---|---|---|
| | $Fe_{70}W_{10}C_{20}$ | 9,500 | 0.08 | 32,000 | 235 | $195 \times 10^{-6}$ |
| | $Fe_{72}Cr_{10}C_{18}$ | 8,500 | 0.03 | 23,000 | 210 | $192 \times 10^{-6}$ |
| | $Fe_{74}Cr_4Mo_4C_{18}$ | 9,000 | 0.03 | 20,000 | — | — |
| Present | $Fe_{72}Cr_4Mo_4W_2C_{18}$ | 7,200 | 0.02 | 40,000 | — | $205 \times 10^{-6}$ |
| invention | $Co_{79}Mo_5C_{16}$ | 6,500 | 0.15 | — | 310 | — |
| | $CO_{76}Mo_8C_{16}$ | 7,000 | 0.10 | — | 260 | — |
| | $Co_{72}Mo_{12}C_{16}$ | 8,100 | 0.02 | 20,000 | 210 | $165 \times 10^{-6}$ |
| | $Co_{68}Mo_{16}C_{16}$ | 6,200 | 0.10 | 10,000 | 160 | — |
| | $Co_{67}Fe_5Mo_{12}C_{16}$ | 9,000 | 0.01 | 32,000 | 250 | $172 \times 10^{-6}$ |
| | $Co_{62}Fe_{10}Mo_{12}C_{16}$ | 12,000 | 0.05 | 15,000 | 310 | $175 \times 10^{-6}$ |

TABLE 7(b)

| | Alloy | Magnetic properties of alloys of present invention and commercially available alloys: Saturation magnetic flux density Bs (Gauss) | Coercive force Hc (Oersted) | Initial permeability (μo) | Curie temperature Tc (°C.) | Specific resistance ρ (Ω . cm) |
|---|---|---|---|---|---|---|
| | $Co_{62}Ni_{10}Mo_{12}C_{16}$ | 7,000 | 0.12 | 12,000 | 180 | — |
| | $Fe_{71}Co_5Mo_8C_{16}$ | 11,600 | 0.10 | 25,000 | — | — |
| Present | $Fe_{66}Co_{10}Mo_8C_{16}$ | 12,000 | 0.11 | 21,000 | 270 | $180 \times 10^{-6}$ |
| invention | $Fe_{61}Co_{15}Mo_8C_{16}$ | 9,500 | 0.11 | 18,000 | 250 | — |
| | $Fe_{71}Ni_5Mo_8C_{16}$ | 10,800 | 0.08 | 15,000 | 220 | — |
| | $Fe_{61}Ni_{15}Mo_8C_{16}$ | 8,000 | 0.05 | 18,000 | 180 | $180 \times 10^{-6}$ |
| Comparative | Supermalloy | 7,700 | 0.01 | 50,000 | 460 | $60 \times 10^{-6}$ |
| alloys | Sendust | 10,000 | 0.05 | 30,000 | 500 | $80 \times 10^{-6}$ |
| | Ferrite (monocrystal) | 4,000 | 0.02 | 20,000 | 180 | 3 |

The alloys of the present invention having high permeability can be annealed at a temperature lower than the crystallizing temperature. Furthermore, if necessary, the above described annealing treatment can be carried out under stress and/or magnetic field. The amorphous alloys can be adjusted to the shape of the hysteresis curve by the annealing treatment depending upon the use. The alloys of the present invention having high permeability can be used for wire materials or sheet materials, for iron cores of transformers, motors, magnetic amplifiers, or acoustic, video and card reader magnetic cores, magnetic filters, thermal sensor and the like.

It has been newly found that the alloys wherein X is at least one of Fe and Co, a is 16–70 atomic%, b is 0–20 atomic%, c is 20–38 atomic% and d is 10–26 atomic% are non-magnetic. Also, when at least one of Fe and Co in X of these alloys is substituted with not less than 10 atomic% of Ni, non-magnetic alloys can be obtained.

However, the conventional crystal alloys having the same component composition range as the above described alloy component composition range are ferromagnetic. The inventors have newly found that the reason why the amorphous alloys are non-magnetic and the crystal alloys are ferromagnetic, even if both the alloys have the same component composition, is based on the fact that curie temperature becomes lower than room temperature in the amorphous alloys. Accordingly, these alloys are suitable for part materials for which the influence of the magnetic field is not desired, for example, for part materials for watches, precise measuring instruments and the like.

In the alloys of the present invention, when X consists of Co and Fe and is shown by the formula $$X_a=(Co_{1-\alpha}Fe_\alpha)_a$$

wherein α is 0.02–0.1 and a is 54–86 atomic%, and b is 0 atomic%, c is 4–20 atomic% and d is 10–26 atomic%, the magnetostriction becomes very small and the alloys having permeability of 10,000–30,000, Bs of less than 10,000 G, Hc of less than 0.10e and Hv of more than 1,000 DPN can be easily obtained and an embodiment of such alloy composition is $Co_{67}Fe_5Mo_{12}C_{16}$ shown in Table 7.

When the alloy composition is shown by the formula $$(CO_{1-\alpha}Fe_\alpha)_aCr_bMo_cQ_d,$$

the alloys of the present invention wherein α is 0.02–0.1, a is 74–84 atomic%, b is 0 atomic%, c is 4–10 atomic% and d is 12–16 atomic%, are particularly preferable low magnetostriction materials. In these alloys, the addition of Cr contributes to improve the magnetic stabilization and the corrosion resistance.

It has been found that in the alloys of the present invention, the alloys wherein X is shown by the following formula $$X_a=(Co_{1-\alpha-\gamma}Fe_\alpha Ni_\gamma)_a,$$

in which $\alpha$ is 0.02–0.1, $\gamma$ is less than 0.12, a is 54–86 atomic%, and b is 0 atomic%, c is 4–20 atomic% and d is 10–26 atomic%, are substantially 0 in the magnetostriction, and by containing Ni, the amorphous alloy forming ability is particularly improved.

The examples wherein the tests of the physical properties, the magnetic properties and the corrosion resistance of the amorphous alloys of the present invention have been made, are shown hereinafter.

EXAMPLE 1

Blades made of carbon steels, hard stainless steels and low alloy steels have been heretofore broadly used for razors, paper cutter and the like and as the properties suitable for blades, the high hardness, corrosion resistance, elasticity and wear resistance have been required. It has been found that the alloys of the present invention are provided with the above described properties and are very excellent. The hardness and the weight decrease, that is the worn amount when the alloys were worn on emery papers (#400) by adding a load of 193 g for 10 minutes are shown in Table 8 by comparing with the commercially available blades. The worn amounts in this table show the results obtained by measuring twice with respect to the same sample.

TABLE 8

Result of wear test of commercially available safety razor blade and alloy blade of present invention

| | Alloy | Hardness Hv (DPN) | Worn amount (mg) Run distance 85 m | | Run distance 205 m | |
|---|---|---|---|---|---|---|
| Present invention | $Fe_{56}Cr_{26}C_{18}$ | 930 | 0.49 | 0.52 | 0.99 | 1.01 |
| | $Fe_{62}Mo_{20}C_{18}$ | 970 | 0.51 | 0.48 | 1.05 | 0.88 |
| | $Fe_{66}W_{14}C_{20}$ | 1050 | 0.15 | 0.14 | 0.37 | 0.31 |
| | $Fe_{54}Cr_{20}Mo_8C_{18}$ | 1010 | 0.18 | 0.17 | 0.41 | 0.33 |
| | $Fe_{46}Cr_{16}Mo_{20}C_{18}$ | 1130 | 0.13 | 0.14 | 0.30 | 0.28 |
| | $Fe_{59}Cr_{13}Mo_8W_4C_{16}$ | 1020 | 0.15 | 0.22 | 0.54 | 0.33 |
| Commercially available razor blade | W Company product | 659 | 14.5 | 15.5 | 43.3 | 45.3 |
| | F Company product (higher stainless steel) | 710 | 12.1 | 13.1 | 33.3 | 33.6 |
| | F Company C product | 1023 | 10.5 | 13.3 | 31.5 | 30.0 |
| | P Company product | 728 | 15.0 | 13.9 | 42.0 | 42.4 |
| | G Company product | 722 | 15.0 | 14.5 | 38.7 | 37.1 |

From this table it can be seen that the worn amount of the blades of the alloys of the present invention is less than 1/100 of that of the commercially available razor blades.

EXAMPLE 2

The properties of the alloys of the present invention as the reinforcing material and the used results are shown in Table 9 by comparing with piano steel wire, glass fiber and nylon filament, which have been practically used as the reinforcing material.

TABLE 9

Comparison of properties of present invention and various reinforcing materials

| Properties | Piano steel wire | Glass fiber | Nylon fiber | Alloy wire of present invention $Fe_{52}Mo_{12}Cr_8C_{18}$ |
|---|---|---|---|---|
| Tensile strength at room temperature (kg/mm$^2$) | 250–300 | 220 | 75–118 | 300–400 |
| Tensile strength at hight temperature (100° C.) (kg/mm$^2$) | 200–250 | 180 | <50 | 250–330 |
| Heat resistant temperature (°C.) | 550 | 350 | 150 | 500 |
| Thermal conductivity | good | somewhat good | poor | good |
| Adhesion (rubber, plastic) | necessary copper, brass plating | poor | good | good |
| Bending fatigue limit (kg/mm$^2$) | 35–45 | 20 | <20 | 60–90 |

As seen from the above table, the tensile strength required as the reinforcing material is 50–100 kg/mm$^2$ higher than that of piano wire and the tensile strength at high temperature and the bending fatigue limit are also higher. The adhesion which is required as another important property is good when using as the reinforcing material for rubber and plastics.

As the reinforcing material, steel wire, synthetic fibers and glass fibers have been heretofore used but it is difficult to more increase the fatigue strength obtained by steel wire and it has been well known that synthetic fibers and glass fibers cannot obtain the higher fatigue strength than steel wire. For reinforcing synthetic resins, matformed reinforcing material obtained by mainly processing glass fibers has been heretofore used and the reinforcing material is good in the corrosion resistance but is brittle, so that the bending strength is not satisfactory.

Concrete structures involve PC concrete using steel wires or steel ropes as the reinforcing material, concrete randomly mixing short cut steel wires and the like but any of them has defect in view of corrosion resistance. However, when the alloys of the present invention are used as the reinforcing material, they can be very advantageously used as the reinforcing material for the above described rubbers, synthetic resins, concrete and the like. An explanation will be made with respect to several embodiments hereinafter.

(A) $Fe_{56}Cr_{26}C_{18}$ and $Fe_{26}Cr_{12}Mo_8C_{18}$ amorphous alloy filaments having a breadth of 0.06 mm and a thickness of 0.04 mm were manufactured by using the apparatus shown in FIG. 1, (a), these filaments were woven into networks and these networks were embedded into tire rubber to obtain test pieces.

The distance of the mesh was 1 mm and the test piece is a plate 3×20×100 mm. When the rubber was vulcanized, the test piece was heated to about 150°–180° C. for 1 hour. By using this test piece, the fatigue test (amplitude elongation: 1 cm) was conducted for a long time by means of a tensile type fatigue tester. As the result, the breakage did not occur even in $10^6$ cycle and the separation of the alloy filaments from the rubber was not observed. This is due to the fact that $Fe_{62}Cr_1$-

$_2Mo_8C_{18}$ alloy has excellent fracture strength (330 kg/mm$^2$), crystallizing temperature (565° C.) and fatigue strength (82 kg/mm$^2$). Furthermore, the alloys for rubber must endure corrosion due to sulfur. The above described alloy filaments were embedded in an excessively vulcanized rubber and left to stand at 30° C. for about one year and then the surface of the alloy filament and the strength were examined but there was substantially no variation.

(B) $Fe_{56}Cr_{26}C_{18}$, $Fe_{74}Mo_8C_{18}$ and $Fe_{62}Cr_{12}Mo_8C_{18}$ amorphous alloy filaments having 0.05 mmϕ were manufactured by means of the apparatus shown in FIG. 1, (a) and the filaments were cut into a given length and a given amount of the cut filaments were mixed in resin concrete. The shape of the test piece was a square pillar 15×15×52 cm, the distance supporting said test piece was 45 cm and the points applying load were two points 15 cm distant from each supporting point. The results of the bending test as shown in Table 10.

TABLE 10

| | Result of bending test of concrete reinforced with alloy fibers ($Fe_{62}Cr_{12}Mo_8C_{18}$ alloy) of present invention | | | |
|---|---|---|---|---|
| Test No. | Fiber length (cm) | Mixing ratio of fiber (volume %) | Maximum load (kg) | Strain at maximum load (mm) |
| 1 | — | — | 1,730 | 0.38 |
| 2 | 5 | 0.5 | 4,870 | 0.50 |
| 3 | 5 | 1 | 5,950 | 0.65 |
| 4 | 10 | 0.5 | 4,600 | 0.48 |
| 5 | 10 | 1 | 4,950 | 0.60 |

As seen from the above table, the concrete reinforced with the alloy filaments has the maximum load of about 3–4 times as large as the concrete not reinforced and the strain of about 2 times as large as the concrete not reinforced. Namely, in the strength and the strain, the concrete reinforced with the alloy filaments has the strength of 1.5–2.0 times as high as the general steel reinforced concrete.

EXAMPLE 3

$Fe_{56}Cr_{26}C_{18}$ alloy plate according to the present invention having a breadth of 50 mm and a thickness of 0.05 mm was manufactured by means of the apparatus as shown in FIG. 1, (a) and this plate was immersed in sea water for 6 months. For comparison, commercially available 12% Cr steel plate and 18% Cr-8% Ni stainless steel plate were used. As the result, 12% Cr steel was corroded and broken in about 10 days and 18–8 steel was corroded and broken in about 50 days but the alloy of the present invention was not corroded after 6 months. The commercially available 12% Cr steel was general corroded due to rust and 18–8 steel caused pitting corrosion and many corroded pits and rusts were observed on the surface.

EXAMPLE 4

$Fe_{74}Mo_8C_{18}$ alloy filament of the present invention having a breadth of 0.5 mm and a thickness of 0.05 mm was manufactured by means of the apparatus of FIG. 1, (a) and the filaments were packed 5 cm at the center of a quartz glass tube having a diameter of 20 mm. 2% aqueous suspension of $Fe_3O_4$ powders was flowed through the quartz glass tube at a rate of 10 cc/sec while applying magnetic field of about 100 Oersted from the outer portion. By this process, 98–99% of ferro-magnetic powders in the solution was removed. That is, this alloy is useful as the filter.

EXAMPLE 5

There has been substantially no alloy having non-magnetic property and high strength and ductility in the commercially available metal materials. For example, in order to make ferromagnetic steel materials non-magnetic, an alloy having a large amount of chromium is produced or an alloy containing nickel or manganese is produced to form austenite phase. Presently, the useful non-magnetic alloy is Fe-Ni alloy containing not less than about 30% of nickel but the strength of this alloy is about 80 kg/mm$^2$. However, the alloys of the present invention are non-magnetic materials having a fracture strength of about 300–400 kg/mm$^2$ and toughness and can be used as the materials for producing articles suitable for these properties. For example, the stop and shutter materials of camera must be non-magnetic and have wear resistance. Presently aluminum alloys have been used. When $Fe_{72}Cr_{12}C_{16}$ alloy sheet of the present invention having a breadth of 5 cm and a thickness of 0.05 mm produced by the twin roll process was punched by punching process to form stop blades and the obtained blades were used, any trouble did not occur owing to the outer magnetic field and the wear resistance was about 1,000 times as long as the conventional aluminum alloy blades and the durable life of the stop blades was noticeably increased.

In addition, as the specific use, there is a relay line, when attenuation of ultrasonic wave was measured by using $Fe_{72}Cr_{12}C_{16}$ alloy wire, dB/cm was about 0.08 and was near 0.06 of quartz glass which has been heretofore known to have the best property and further this alloy has the characteristic that the alloy is not embrittled as in glass. As the metal materials for the relay line, Fe-Ni series Elinvar alloy has been frequently used but dB/cm is as high as about 10. Therefore, the alloy of the present invention can be advantageously used as the material for the relay line.

As mentioned above, the alloys of the present invention are high in the hardness and strength and excellent in the fatigue limit and the corrosion resistance and may be non-magnetic and the alloys are more cheap and can be more easily produced than the conventional amorphous alloys and can expect a large number of uses.

The alloys of the present invention can be produced into powders, wires or sheets depending upon the use.

INDUSTRIAL APPLICABILITY

The amorphous alloys of the present invention can be utilized for tools, such as blades, saws and the like, hard wires, reinforcing materials for rubber, plastics, concrete and the like, mix-spinning materials, corrosion resistant materials, magnetic materials, non-magnetic materials and the like. Amorphous alloys having various properties can be produced depending upon the component composition and the use is broad depending upon the properties.

We claim:

1. Carbon series amorphous alloys characterized in that carbon is used as a metalloid having amorphous alloy forming ability and having a component composition substantially shown by the following formula $$[X_aCr_bM_cQ_d]X_aM_cQ_d$$

wherein X is a atomic% of at least one selected from Fe, Co and Ni, M is atomic% of at least one selected from Mo and W, Q is carbon or a combination of carbon and nitrogen contained in an amount of d atomic%, a is 14–86, c is 4–38, d is 10–26 and the sum of a, c and d is 100, and a part of M may be at least one element selected from the group (A) consisting of V, Ta and Mn, at least one element selected from the group (B) consisting of Nb, Ti and Zr, or a combination of at least one element selected from the above described group (A) and at least one element selected from the above described group (B) and the content of the group of V, Ta and Mn and the group of Nb, Ti and Zr is not more than 10 atomic% and not more than 5 atomic% respectively, and the content of N is not more than 4 atomic%.

2. The alloys as claimed in claim 1, wherein a is 14–86, c is 10–38, and d is 14–26 said alloys having high strength, hardness and crystallizing temperature.

3. The alloys as claimed in claim 1, wherein $$X_a=[(Ni, Co)_{1-\beta}Fe_\beta]_a$$

wherein $\beta$ is 0–0.30, a is 38–86, c is 4–20 and d is 10–20, said alloys having high embrittling temperature.

4. The alloys as claimed in claim 1, wherein a is 14–84, c is 4–38 and d is 10–26 said alloys having high corrosion resistance.

5. The alloys as claimed in claim 1, wherein X is at least one of Fe and Co, a is 54–86, c is 4–20 and d is 10–26 said alloys having high permeability.

6. The alloys as claimed in claim 1, wherein X is at least one of Fe and Co, a is 16–70, c is 20–38 and d is 10–26.

7. The alloys as claimed in claim 1, wherein X consists of Co and Fe, $$X_a=(Co_{1-\alpha}Fe_\alpha)_a$$

wherein $\alpha$ is 0.02–0.1, a is 54–86 c is 4–20 and d is 10–26, said alloys having low magnetostriction.

8. The alloys as claimed in claim 1, wherein X consists of Co, Fe and Ni, $$X_a=(Co_{1-\alpha-\gamma}Fe_\alpha Ni_\gamma)_a$$

wherein $\alpha$ is 0.02–0.1, $\gamma$ is not more than 0.12%, a is 54–86, c is 4–20 and d is 10–26, said alloys having low magnetostriction.

9. Powders, wires or sheets manufactured from alloy as claimed in claims 1, 2, 3, 4, 5, 6, 7 or 8.

10. Carbon series amorphous alloys characterized in that carbon is used as metalloid having amorphous alloy forming ability and having a component composition substantially shown by the following formula $$X_aCr_bM_cQ_d$$

wherein X is at least one element selected from Co and Ni, M is at least one element selected from Cr, Mo and W, Q is carbon or a combination of carbon and nitrogen, a is 14–86 atomic%, b is less than 22 atomic%, c is 4–38 atomic%, d is 10–26 atomic% and the sum of a, b, c and d is 100, and a part of M may be at least one element selected from the group (A) consisting of V, Ta and Mn, at least one element selected from the group (B) consisting of Nb, Ti and Zr, or a combination of at least one element selected from the above described group (A) and at least one element selected from the above described group (B) and the content of the group of V, Ta and Mn and the group of Nb, Ti and Zr is not more than 10 atomic% and not more than 5 atomic % respectively, and the content of N is not more than 4 atomic%.

11. The alloys as claimed in claim 10, wherein a is 14–86, b is 10–22, c is 10–38, and d is 14–26, said alloys having high strength, hardness and crystallizing temperature.

12. The alloys as claimed in claim 10, wherein a is 14–84, b is 2–22, c is 4–38 and d is 10–26, said alloys having high corrosion resistance.

13. Powders, wires or sheets manufactured from alloy as claimed in claim 10, 11 or 12.

14. Carbon series amorphous alloys characterized in that carbon is used as a metalloid having amorphous alloy forming ability and having a component composition substantially shown by the following formula $$X_aCr_bM_cQ_d$$

wherein X is Fe-Co, Fe-Ni or Fe-Ni-Co, M is at least one element selected from Cr, Mo and W, Q is carbon or a combination of carbon and nitrogen, a is 14–86 atomic%, but at least one of Co and Ni is not less than 40 atomic%, b is less than 22 atomic%, C is 4–38 atomic%, d is 10–26 atomic% and the sum of a, b, c and d is 100, and a part of M may be at least one element selected from the group (A) consisting of V, Ta and Mn, at least one element selected from the group (B) consisting of Nb, Ti and Zr, or a combination of at least one element selected from the above described group (A) and at least one element selected from the above described group (B) and the content of the group of V, Ta and Mn and the group of Nb, Ti and Zr is not more than 10 atomic% and not more than 5 atomic % respectively, and the content of N is not more than 4 atomic%.

15. The alloys as claimed in claim 14, wherein a is 14–86, b is 10–22, c is 10–38, and d is 14–26, said alloys having high strength, hardness and crystallizing temperature.

16. The alloys as claimed in claim 14, wherein a is 14–84, b is 2–22, c is 4–38 and d is 10–26, said alloys having high corrosion resistance.

17. Powders, wires or sheets manufactured from alloy as claimed in claim 14, 15 or 16.

* * * * *